US012780463B2

(12) United States Patent
Van Rijsewijk

(10) Patent No.: US 12,780,463 B2
(45) Date of Patent: Nov. 3, 2026

(54) MANDREL AND METHOD OF SPREADING OPEN A FLATTENED TUBULAR FOIL

(71) Applicant: Fuji Seal International, Inc., Osaka (JP)

(72) Inventor: Lucas Van Rijsewijk, Boxtel (NL)

(73) Assignee: Fuji Seal International, Inc., Osaka (JP)

( * ) Notice: Subject to any disclaimer, the term of this patent is extended or adjusted under 35 U.S.C. 154(b) by 0 days.

(21) Appl. No.: 19/120,032

(22) PCT Filed: Oct. 5, 2023

(86) PCT No.: PCT/IB2023/060002
§ 371 (c)(1),
(2) Date: Apr. 10, 2025

(87) PCT Pub. No.: WO2024/079576
PCT Pub. Date: Apr. 18, 2024

(65) Prior Publication Data

US 2026/0131922 A1 May 14, 2026

(30) Foreign Application Priority Data

Oct. 14, 2022 (NL) ..... 2033313

(51) Int. Cl.
*B65B 9/14* (2006.01)
*B65B 61/06* (2006.01)

(52) U.S. Cl.
CPC ..... *B65B 9/14* (2013.01); *B65B 61/06* (2013.01)

(58) Field of Classification Search
CPC .. B65B 9/14; B65B 61/06; B65C 3/00; B65C 3/065; B65C 3/14
See application file for complete search history.

(56) References Cited

U.S. PATENT DOCUMENTS 3,370,116 A * 2/1968 Wrede ..... B29C 48/13 26/84
4,587,795 A * 5/1986 Yamashita ..... B65B 9/213 53/554

(Continued)

FOREIGN PATENT DOCUMENTS

WO 99/30970 A1 6/1999
WO 2011/031160 A1 3/2011

OTHER PUBLICATIONS

International Search Report and Written Opinoin mailed Feb. 7, 2024, issued for PCT/IB2023/060002.

*Primary Examiner* — Dariush Seif
(74) *Attorney, Agent, or Firm* — Troutman Pepper Locke LLP

(57) ABSTRACT

There is provided a mandrel to be suspended in a sleeving device, for spreading open a flattened tubular foil into a tubular form having a rounded cross section, having a spreading portion which extends in a feeding direction of the foil along a central axis of the mandrel and which is configured to change a cross section of the tubular foil from a flattened cross section into a rounded cross section. The spreading portion comprises, in a feeding direction of the tubular foil, a first length section configured to change the cross section of the tubular foil from the flattened cross section into a first polygonal cross section defined by four corner points, and a second length section configured to change the cross section of the tubular foil from the first polygonal cross section into a second polygonal cross section defined by eight or more corner points.

17 Claims, 10 Drawing Sheets

(56) References Cited

U.S. PATENT DOCUMENTS 4,640,083 A * 2/1987 Takahashi ..... B65B 39/04 141/285
4,765,121 A * 8/1988 Konstantin ..... B65B 53/063 53/442
4,806,187 A * 2/1989 Fujisawa ..... B65B 9/14 53/291
5,255,497 A * 10/1993 Zoromski ..... B65B 9/2042 53/551
5,566,527 A * 10/1996 Drewitz ..... B65B 7/2885 53/295
5,732,532 A * 3/1998 Fujisaki ..... B65B 9/213 141/10
6,070,399 A * 6/2000 Huang ..... B65B 9/14 53/291
6,523,331 B1 2/2003 Fresnel
8,621,745 B2 * 1/2014 Deonarine ..... B65C 9/0065 29/793
9,199,750 B2 * 12/2015 Sawamura ..... B65C 3/065
9,278,773 B2 * 3/2016 Arima ..... B29C 63/423
9,334,073 B2 * 5/2016 Heeman ..... B65B 61/08
9,643,743 B2 * 5/2017 Heeman ..... B29C 63/423
9,840,344 B2 * 12/2017 Grabher ..... B65B 3/027
9,889,960 B2 * 2/2018 Duncan ..... B65C 3/065
10,081,447 B2 * 9/2018 Van Rijsewijk ..... B65B 9/14
10,131,459 B2 * 11/2018 Van Rijsewijk ..... B65B 57/04
10,611,508 B2 * 4/2020 Wang ..... B65C 9/04
11,345,078 B2 * 5/2022 Van Heck ..... B65B 9/14
12,103,807 B2 * 10/2024 Nock ..... B65H 45/101
12,157,246 B1 * 12/2024 Duncan ..... B65B 61/02
2005/0127079 A1 * 6/2005 Grabher ..... B65B 3/027 220/669
2013/0061559 A1 * 3/2013 Van Rijsewijk ..... B65B 9/14 53/381.5
2013/0118119 A1 * 5/2013 Heeman ..... B29C 63/423 53/399
2013/0118120 A1 * 5/2013 Heeman ..... B65B 11/00 53/399
2013/0118122 A1 * 5/2013 Heeman ..... B29C 63/18 53/399
2013/0118136 A1 * 5/2013 Arima ..... B65C 9/42 53/585
2014/0241835 A1 * 8/2014 Grabher ..... B65B 3/027 413/2
2014/0366487 A1 * 12/2014 Van Rijsewijk ..... B65B 57/06 53/55
2015/0344159 A1 * 12/2015 Van Rijsewijk ..... B65C 3/065 53/567
2017/0233128 A1 * 8/2017 Lang ..... B29C 65/66 156/86
2017/0291728 A1 * 10/2017 Arima ..... B65C 3/065
2018/0002053 A1 * 1/2018 Wang ..... B65C 9/04
2018/0273227 A1 * 9/2018 Ushidate ..... B65B 53/00
2018/0319528 A1 * 11/2018 Verbeeten ..... B29C 63/423
2019/0106235 A1 * 4/2019 Takeshiba ..... B65C 9/1869
2019/0118461 A1 * 4/2019 Van Heck ..... B65B 21/245
2022/0161953 A1 * 5/2022 Duncan ..... B65C 3/065
2025/0312565 A1 * 10/2025 Carlander ..... A61M 25/002

* cited by examiner

MANDREL AND METHOD OF SPREADING OPEN A FLATTENED TUBULAR FOIL

TECHNICAL FIELD

The present invention relates to a mandrel to be suspended in a sleeving device, a device for forming folds in a flattened tubular foil, a sleeving device, and a method of spreading open a flattened tubular foil into a tubular form having a rounded cross section.

BACKGROUND ART

Mandrels to be suspended in a sleeving device are well known in the art. A mandrel is a spreading element for opening a flattened tubular foil to form a sleeve having a rounded or round cross section that substantially matches the shape of a product, such as a food container, a bottle, a jar, a bowl, a holder etc. The sleeving device usually comprises a frame, a foil feeding unit mounted to the frame for feeding the tubular foil to the mandrel, a cutting unit for cutting the sleeve, and a sleeve dispatch. The mandrel can be suspended on one or more foil transport rollers or wheels in the sleeving device. The foil transport rollers are mounted on the frame of the sleeving device and engage with rollers or wheels mounted on the mandrel, wherein the foil or sleeve is fed between the rollers. In general, the outer surface of the mandrel has an outer circumferential shape that is similar to the inner circumferential shape of the foil or sleeve.

Document US 2013/0118120 A1 discloses a mandrel that is to be suspended in a sleeving device for arranging sleeves around products such as containers. In an embodiment the mandrel is arranged for opening a foil to form a sleeve, the mandrel having a substantially tubular outer surface around which foil is fed. The mandrel is suspended in a vertical position. Foil and sleeves are moved in a downward manner. According to document US 2013/0118120 A1, the tubular outer surface of the mandrel is formed by at least two separate mandrel bodies, wherein at least one mandrel body is biased outwardly to increase the circumference of the outer surface. Using a suitable biasing element the circumference of the outer surface is continually adjusted to varying diameters of the foil during the process without the use of an actuator. Biasing elements can comprise pneumatic or magnetic elements. Similar magnetic poles (repulsing) can be used to create outwardly biased elements. If the foil circumference decreases slightly, the circumference of the outer surface decreases slightly moving against the outwardly biasing force. If the circumference of the foil increases, the biasing foil will increase the circumference of the outer surface.

The outwardly directed bias results in automatically adjusting the circumference of the outer surface of the mandrel to the current inner sleeve circumference. As a result, a sleeve having a rounded cross section can be formed from a flattened tubular foil having a flattened cross section while avoiding wrinkles or creases in the sleeve. However, due to the mandrel of US 2013/0118120 A1 being formed by at least two separate mandrel bodies, the structure of the mandrel is rather complicated and expensive.

SUMMARY OF THE INVENTION

There is a general requirement in providing a mandrel for spreading open a flattened tubular foil into a tubular form having a rounded cross section, wherein the mandrel is able to smoothly open the foil in order to avoid wrinkles or creases. The foil is made from a heat-shrinkable material that is caused to shrink when its temperature is increased. After the foil is spread open by the mandrel, it is cut by a cutting unit into individual sleeves which are put onto and get firmly attached to a product by increasing the temperature. Thus, wrinkles or creases in the sleeve might cause the sleeve not to fit the product properly which then might lead to a product of bad quality.

Therefore, starting from a mandrel as disclosed in US 2013/0118120 A1, it is an object of the invention to provide a mandrel to be suspended in a sleeving device, for spreading open a flattened tubular foil into a tubular form having a rounded cross section, wherein wrinkles or creases in the foil can be avoided and wherein the mandrel has a simple structure and can be produced at relatively low cost. Further, it is an object of the invention to provide a method of spreading open a flattened tubular foil into a tubular form having a rounded cross section, wherein wrinkles or creases in the foil can be avoided.

These objects are achieved by the subject-matters of independent claims 1 and 17. Advantageous further developments are laid out in the dependent claims.

According to the present invention, a mandrel to be suspended in a sleeving device, for spreading open a flattened tubular foil into a tubular form having a rounded cross section, has a spreading portion which extends in a feeding direction of the foil along a central axis of the mandrel and is configured to change a cross section of the tubular foil from a flattened cross section into a rounded cross section. The spreading portion comprises, in a feeding direction of the tubular foil, a first length section configured to change the cross section of the tubular foil from the flattened cross section into a first polygonal cross section (e.g. a rectangular cross section or a square cross section) defined by four corner points, and a second length section configured to change the cross section of the tubular foil from the first polygonal cross section into a second polygonal cross section (e.g. an octagonal cross section) defined by eight or more corner points.

The term "rounded cross section" is not bound or restricted to a "circular cross section" but is intended to cover a "circular cross section", a "substantially circular cross section", and an "approximately circular cross section". Further, the term "polygonal cross section" is intended to cover polygonal cross sections with sharp corner points as wells polygonal cross sections with rounded or chamfered corner points.

According to the invention, the mandrel serves for opening a flattened tubular foil having a flattened cross section (in an original state) into a tubular form having a rounded cross section (in a final state). The term "foil" is used as an indication for a continuous strip of envelope material from which sleeves are to be cut after having been spread open by the mandrel. Further, the term "flattened cross section" refers to the cross section of the foil in a state before being fed over the mandrel (original state). Moreover, the term "rounded cross section" refers to the final cross section of the foil obtained by being fed over and along the mandrel (final state) before being further processed, e.g. by being cut by a cutting unit which may be arranged behind the mandrel in a feeding direction of the tubular foil.

The mandrel according to the invention has the spreading portion which comprises a first length section configured to change the cross section of the tubular foil from the flattened cross section into a first polygonal cross section defined by four corner points. That is, the first length section is configured to spread open the tubular foil and transform or change the cross section of the foil from the originally flattened state into the first polygonal cross section. The actual structure of the first length section may be any structure capable of transforming the cross section of the foil into a polygonal cross section defined by four corner points. Specifically, the first length section may be any (first) three dimensional structure (whether its contour is formed from closed side surfaces or from partially open side surfaces) having four pronounced corner regions configured to contact the tubular foil, to guide the tubular foil in the feeding direction, and to reshape the tubular foil into a tubular shape having the first polygonal cross section along a complete length of the first length section. According to the invention, the spreading portion comprises a second length section configured to transform or change the cross section of the tubular foil from the first polygonal cross section into a second polygonal cross section defined by eight or more corner points. Similar to the first length section, the actual structure of the second length section may be any structure capable of transforming the cross section of the foil from the first polygonal cross section into the second polygonal cross section defined by eight or more corner points. Specifically, the second length section may be any (second) three dimensional structure (whether its contour is formed from closed side surfaces or from partially open side surfaces) having eight or more pronounced corner regions configured to contact the tubular foil, to guide the tubular foil in the feeding direction, and to reshape the tubular foil into a tubular shape having the second polygonal cross section along a complete length of the second length section. The terms "change" and "reshape" have the same meaning in the present application.

The mandrel according to the present invention is able to smoothly spread open a flattened tubular foil into a tubular form having a rounded cross section as the second length section configured to change the cross section of the tubular foil into the second polygonal cross section defined by eight or more corner points is provided. The second polygonal cross section defined by eight or more corner points of the foil approaches a rounded cross section. Thus, a transition of the polygonal cross section defined by eight or more corner points into a rounded cross section can be smoothly and easily performed, wherein wrinkles or creases in the foil can be avoided and wherein the mandrel has a simple structure and can be produced at relatively low cost.

In a preferred embodiment, the first length section is configured to change the cross section of the tubular foil from the flattened cross section into a rectangular cross section and, then, into a square cross section. As the tubular foil has a square cross section at the end of the first length section in a feeding direction of the foil along a central axis of the mandrel, the cross section of the foil can easily be changed into the second polygonal cross section defined by eight or more corner points due to the symmetrical shape of the square cross section.

The second length section may be configured to change the cross section of the tubular foil from the first polygonal cross section into an octagonal cross section. The octagonal shape approaches well a rounded cross section. Thus, a transition from the octagonal cross section into the rounded cross section can be smoothly performed, wherein wrinkles or creases may be avoided.

In a preferred embodiment, the second length section is further configured to change the cross section of the tubular foil from a first octagonal cross section into a second octagonal cross section, wherein the first octagonal cross section is a non-equilateral octagonal cross section and the second octagonal cross section is an equilateral octagonal cross section. The equilateral octagonal shape is a good compromise between a simple shape and an approximation of a rounded shape.

The spreading portion may comprise a third length section following the second length section, which is configured to guide the tubular foil with the second polygonal cross section along the feeding direction without causing a (further) change of the cross section of the tubular foil. Specifically, the third length section may be any (third) three dimensional structure (whether its contour is formed from closed side surfaces or from partially open side surfaces) having eight or more pronounced corner regions configured to contact the tubular foil, to guide the tubular foil in the feeding direction, and to reshape the tubular foil into a tubular shape having the second polygonal cross section along a complete length of the third length section.

In this case, the mandrel may further have an advancing means with at least one driving wheel rotatably mounted inside the third length section so that a circumferential surface of the driving wheel is flush with an outer surface of the third length section. As the circumferential surface of the driving wheel is flush with an outer surface of the third length section, the foil which is guided between the driving wheel and a servo driven wheel provided outside of the mandrel can be fed over the mandrel without causing any wrinkles or creases in the foil. Specifically, if no foil is provided between the driving wheel and the servo driven wheel, the contact between the driving wheel and the servo driven wheel results in a straight line.

In a preferred embodiment, the mandrel may further have a rounding portion configured to change the cross section of the tubular foil from the second polygonal cross section into a rounded cross section. Thus, the second polygonal cross section of the foil which is already a good approximation of a rounded cross section can be changed to the final rounded cross section by the rounding portion. Specifically, the rounding portion may be any three dimensional structure (whether its contour is formed from closed side surfaces or from partially open side surfaces) having a round cross section configured to contact the tubular foil, to guide the tubular foil in the feeding direction, and to reshape the tubular foil into a round tubular shape.

The mandrel may be configured to change or reshape the cross section of the tubular foil from the flattened tubular cross section into the rounded cross section so that the tubular foil has a same circumferential length at any position along the central axis of the mandrel, i.e. without over-stretching the tubular foil. The term "over-stretching" means an increase of the circumferential length of the cross section of the tubular foil. By keeping the circumferential length of the cross section of the tubular foil constant over the entire length of the mandrel in a feeding direction, wrinkles and creases in the foil can be avoided.

The mandrel may be configured to change the cross section of the tubular foil from the flattened cross section into the rounded cross section so that if, a first cross section of the foil at any first position along the central axis of the mandrel is divided into a specific number of nodes N1 to Nn being located at equal distances from each other along the circumference of the first cross section, and a second cross section of the foil at any second position along the central axis of the mandrel is divided into the specific number of nodes M1 to Mn being located at equal distances from each other along the circumference of the second cross section, distances N1-M1, N2-M2, to Nn-Mn on the tubular foil between equally numbered nodes at the first position and the second position are equal, wherein nodes N1 and M1 are located in a symmetry plane of the mandrel containing the central axis of the mandrel. Thereby, a change of a length of the tubular foil in the feeding direction can be avoided, thereby preventing wrinkles and creases in the foil.

As above outlined, any polygonal cross section of the tubular foil may have rounded or chamfered corner points. The foil is made from a heat shrinkable material which is flexible. Therefore, the corner points of the foil may be rounded or chamfered instead of being sharp.

In a preferred embodiment, a cross section of the spreading portion at any position along the central axis is defined by n contact points configured to contact the tubular foil, with n=4 along the first length section and n≥8 along the second length section, so that a polygonal chain of straight line segments connecting the n contact points defines a polygonal cross section of the tubular foil. Thus, n=4 contact points in the first length section are provided for creating the first polygonal cross section of the tubular foil defined by four corner points, and the n≥8 contact points in the second length section are provided for creating the second polygonal cross section of the tubular foil defined by eight or more corner points.

In this case, the spreading portion may be formed by a wedge-like structure wherein each of the first length section and second length section is defined by trapezoidal side surfaces tapering in a feeding direction of the tubular foil, wherein the n contact points lie on side edges of the trapezoidal side surfaces. Thus, the spreading portion can be formed by elements with surfaces having a relatively simple shape.

Specifically, the trapezoidal side surfaces may be connected by triangular side surfaces. Accordingly, a mandrel can be provided which has a circumferentially closed hollow structure and which is formed by elements having simple geometrical shapes.

As above outlined, the spreading portion may have a three dimensional shape which is defined—in the first length section and/or second length section—by closed side surfaces or by partially open side surfaces, and wherein side edges of the side surfaces are arranged so as to constitute pronounced corner regions which are configured to map corresponding corner points of the first polygonal cross section and second polygonal cross section, respectively, of the tubular foil while being fed along the first length section and second length section.

In a preferred embodiment, the spreading portion comprises a tip portion upstream of the first length section, configured to receive and guide the flattened tubular foil to the first length section.

There may be provided a device for forming folds in a flattened tubular foil, comprising a first mandrel according to any one of the above aspects and a second mandrel according to any one of the above aspects, wherein the first mandrel and second mandrel are arranged such that the central axis of the first mandrel and second mandrel coincide with each other and the tip portions of the first mandrel and second mandrel are positioned opposite to each other, and wherein the second mandrel is turnable with respect to the first mandrel around its central axis so that the first length section and second length section of the first mandrel and second mandrel are not congruent.

Thus, in the above described device, the first and second mandrel lie on the same central axis, however, the second mandrel is turned with respect to the first mandrel around 180 degrees. That is, the above device is configured such that the foil having a second polygonal cross section and leaving the first mandrel is fed over the second length section of the second mandrel first and is then fed over the first length section of the second mandrel and leaves the second mandrel having a flattened tubular cross section. As the second mandrel is turnable with respect to the first mandrel, an orientation of the foil fed over the first mandrel and an orientation of the foil leaving the second mandrel differ from each other. By changing an orientation of the foil by the device, two additional folds can be created in the foil at the edges of the flattened tubular foil leaving the second mandrel. Thus, as the flattened tubular foil being fed over the first mandrel already comprises two folds (factory folds) extending along the foil in a feeding direction at edges of the flattened tubular foil, the device can create foils having a total of four folds. Therefore, after the foil is cut by a cutting device into individual sleeves, the sleeves may be put and shrunk onto products having a rectangular or square cross section. A distance of the additional folds created by the device from each other in a circumferential direction of the foil depends on a turning angle of the first mandrel with respect to the second mandrel. By using two of the mandrels according to any one of the above aspects, the created foil having four folds can be produced while avoiding wrinkles or creases.

According to a further aspect, a sleeving device for arranging a sleeve around a container comprising a frame, a foil feeding unit mounted to the frame and configured to feed a tubular foil to a mandrel according to any one of the above aspects suspended to the frame, a cutting unit for cutting the tubular foil to form a sleeve and a sleeve dispatch are provided.

According to the present invention, a method of spreading open a flattened tubular foil into a tubular form having a rounded cross section is provided, wherein the tubular foil is fed in a feeding direction and a cross section of the tubular foil is changed from a flattened cross section into a rounded cross section. The method comprises the following steps: a first step of changing the cross section of the tubular foil from the flattened cross section into a first polygonal cross section defined by four corner points, and a second step of changing the cross section of the tubular foil from the first polygonal cross section into a second polygonal cross section defined by eight or more corner points.

According to the method, in the first step, the cross section of the tubular foil is changed from the flattened cross section to the first polygonal cross defined by four corner points. Then, in the second step, the cross section of the tubular foil is changed from the first polygonal cross section into a second polygonal cross section defined by eight or more corner points. Therefore, according to the method, after the second step, the cross section of the tubular foil has a second polygonal cross section defined by eight or more corner points. The second polygonal cross section defined by eight or more corner points of the foil approaches well a rounded cross section. Thus, a transition of the polygonal cross section defined by eight or more corner points into a rounded cross section may be smoothly and easily performed, wherein wrinkles or creases in the foil can be avoided.

According to a preferred embodiment, in the first step the cross section of the tubular foil is changed from the flattened cross section into a rectangular cross section and, then, into a square cross section. As the tubular foil has a square cross section at the end of the first step, the cross section of the foil can easily be changed into the second polygonal cross section defined by eight or more corner points due to the symmetrical shape of the square cross section.

In the second step the cross section of the tubular foil may be changed from the first polygonal cross section into an octagonal cross section. The octagonal shape approaches a rounded cross section. Thus, a transition from the octagonal cross section into the rounded cross section can be smoothly performed, wherein wrinkles or creases may be avoided.

In a preferred embodiment, in the second step the cross section of the tubular foil is changed from a first octagonal cross section into a second octagonal cross section, wherein the first octagonal cross section is a non-equilateral octagonal cross section and the second octagonal cross section is an equilateral octagonal cross section. The equilateral octagonal shape is a good compromise between a simple shape and an approximation of a rounded shape.

The method may further comprise a third step of guiding the tubular foil with the second polygonal cross section along the feeding direction.

In a preferred embodiment, the method further comprises a rounding step of changing the cross section of the tubular foil from the second polygonal cross section into a rounded cross section. Thus, in the rounding step, the second polygonal cross section of the foil which is already a good approximation of a rounded cross section can be changed to the final rounded cross section.

The cross section of the tubular foil may be changed from the flattened tubular cross section into the rounded cross section so that a circumferential length of the cross-section of the tubular foil remains constant. By keeping the circumferential length of the cross section of the tubular foil constant at all times, wrinkles and creases in the foil can be avoided.

In a preferred embodiment, the cross section of the tubular foil is changed from the flattened cross section into the rounded cross section so that, if a first cross section of the tubular foil at any first position along the feeding direction of the tubular foil is divided into a specific number of nodes N1 to Nn being located at equal distances from each other along the circumference of the first cross section, and a second cross section of the tubular foil at any second position along the feeding direction is divided into the specific number of nodes M1 to Mn being located at equal distances from each other along the circumference of the second cross section, distances N1-M1, N2-M2, to Nn-Mn on the tubular foil between equally numbered nodes at the first position and the second position are equal, wherein nodes N1 and M1 are located in a symmetry plane of the tubular foil containing a central axis (2) of the tubular foil. Thereby, wrinkles and creases in the foil can be avoided.

In a preferred embodiment, any polygonal cross section of the tubular foil has rounded or chamfered corner points. Therefore, the corner points of the foil may be rounded or chamfered instead of being sharp.

SHORT DESCRIPTION OF THE FIGURES

Embodiments of the invention are described in more detail in the following with the help of the appended figures, wherein.

Figure 4A:
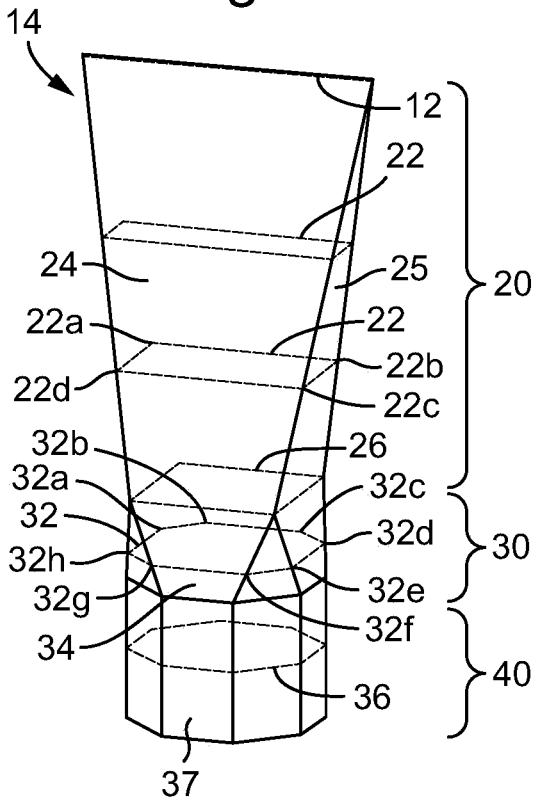

FIG. 4*a* shows a perspective view of the spreading portion of the mandrel according to the first embodiment of the invention indicating different cross sections.

Figure 4B:
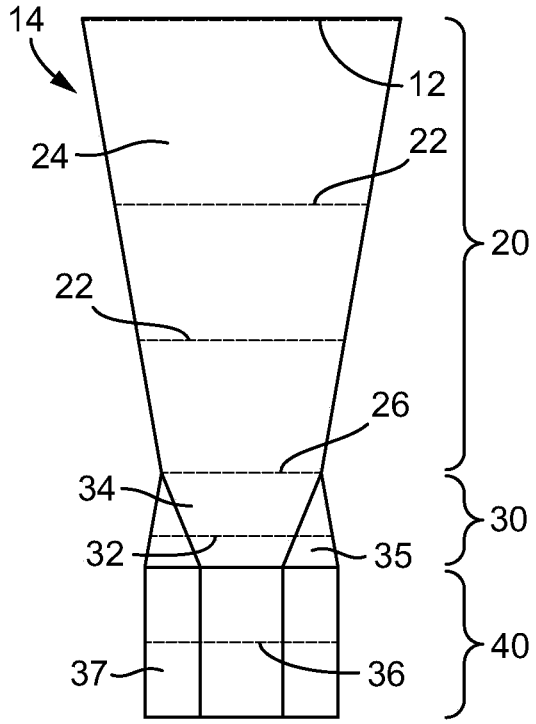

FIG. 4*b* shows a front view of the spreading portion of FIG. 4*a*.

Figure 4C:
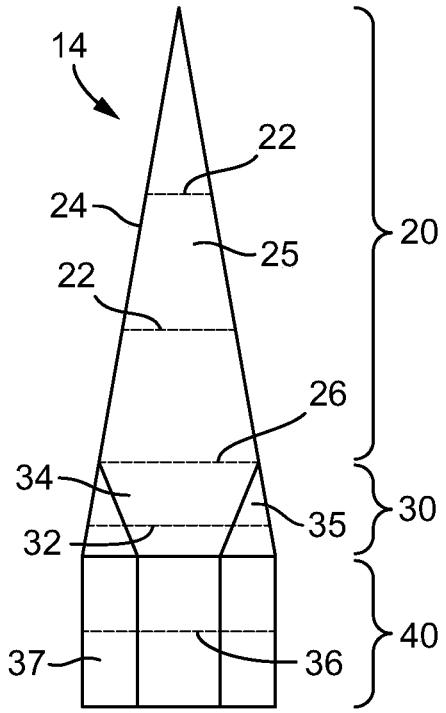

FIG. 4*c* shows a side view of the spreading portion of FIG. 4*a*.

Figure 4D:
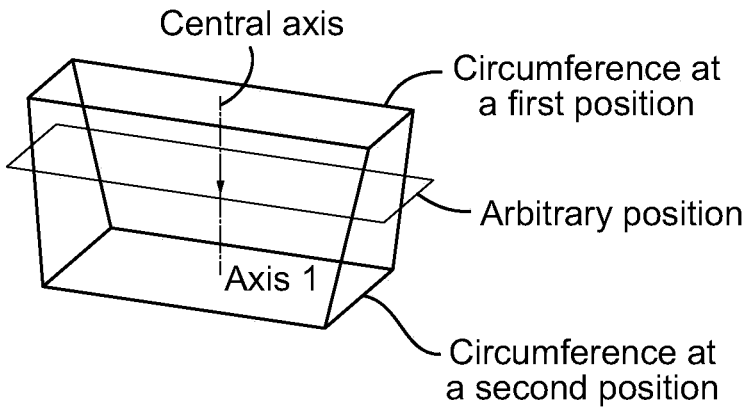

FIG. 4*d* shows circumferences of a tubular foil at a first position and a second position along a central axis of the tubular foil.

Figure 5A:
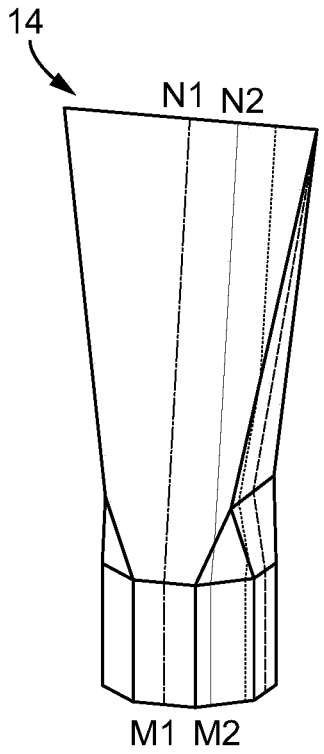

FIG. 5*a* shows a perspective view of the spreading portion of the mandrel according to the first embodiment of the invention indicating distances between corresponding nodes in a feeding direction of the mandrel according to the first embodiment.

Figure 5B:
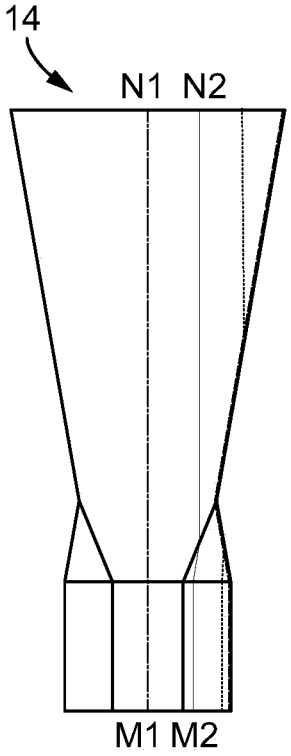

FIG. 5*b* shows a front view of the spreading portion of FIG. 5*a*.

Figure 5C:
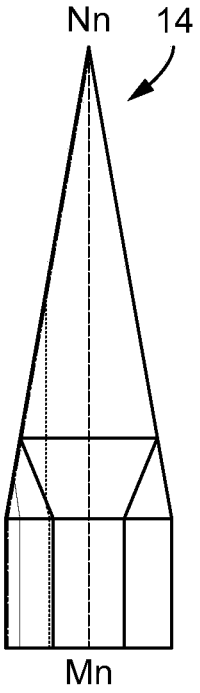

FIG. 5*c* shows a side view of the spreading portion of FIG. 5*a*.

Figure 5D:
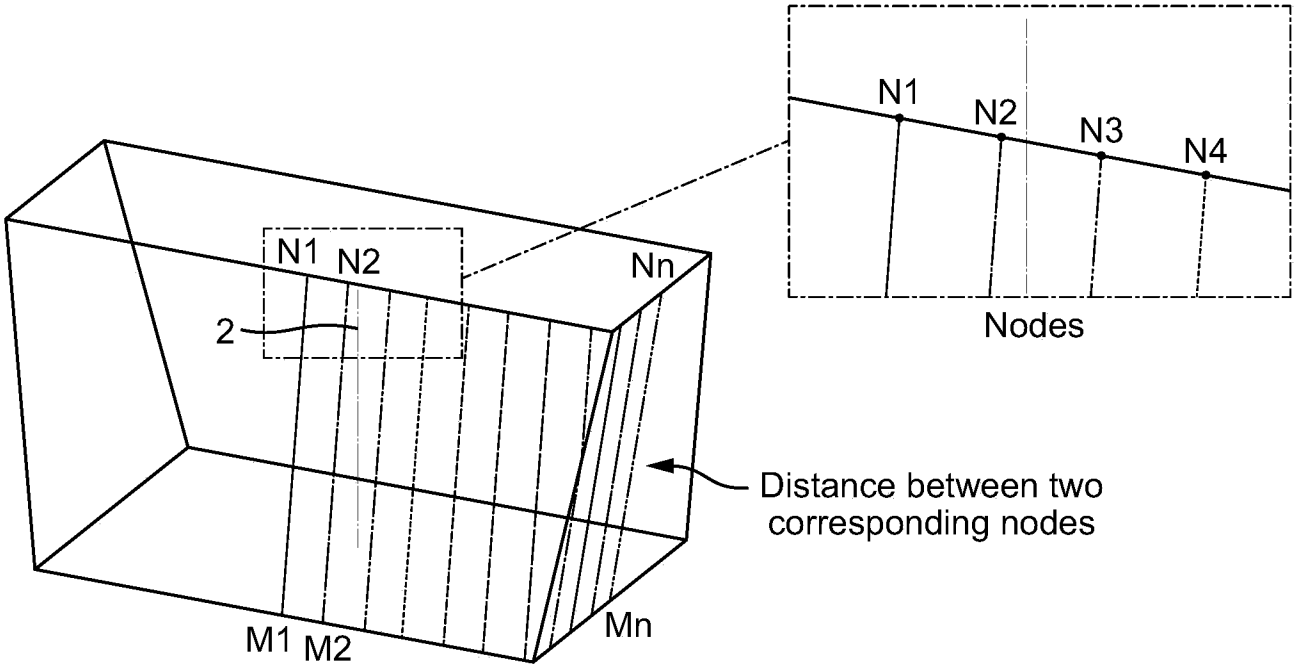

FIG. 5*d* shows distances between corresponding nodes on a circumference of a first cross section of a tubular foil and a circumference on a second cross section of the tubular foil.

Figure 6:
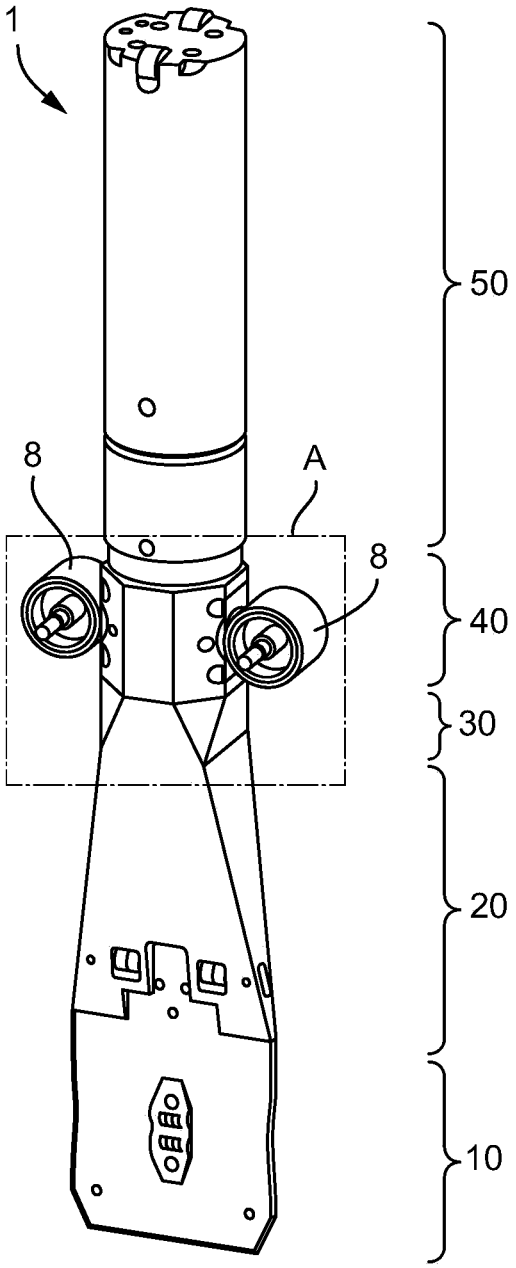

FIG. 6 shows a perspective view of the mandrel according the first embodiment disclosing driving wheels mounted inside a third length section of the mandrel.

Figure 6A:
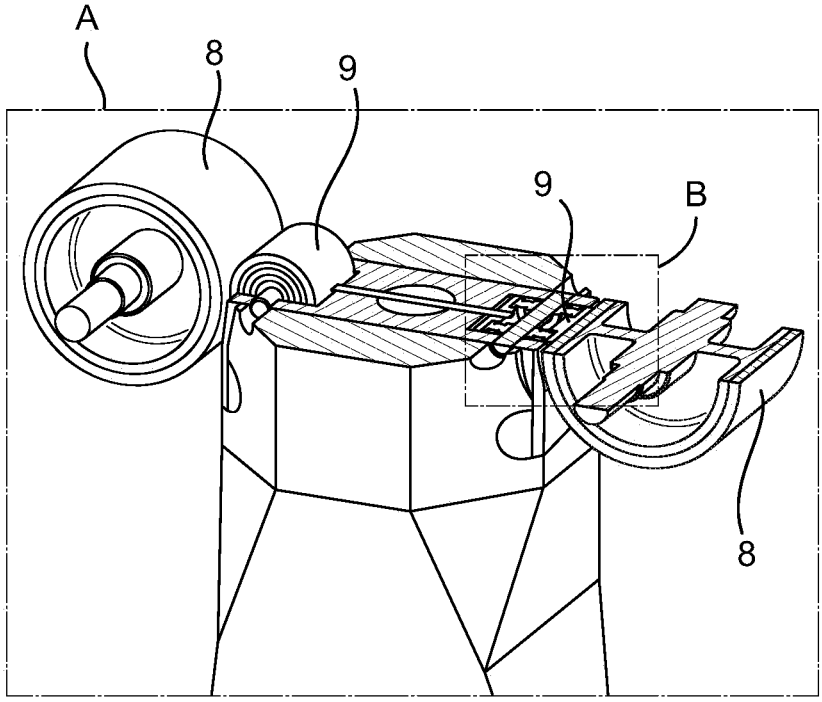

FIG. 6*a* shows an enlarged portion A of FIG. 5.

Figure 6B:
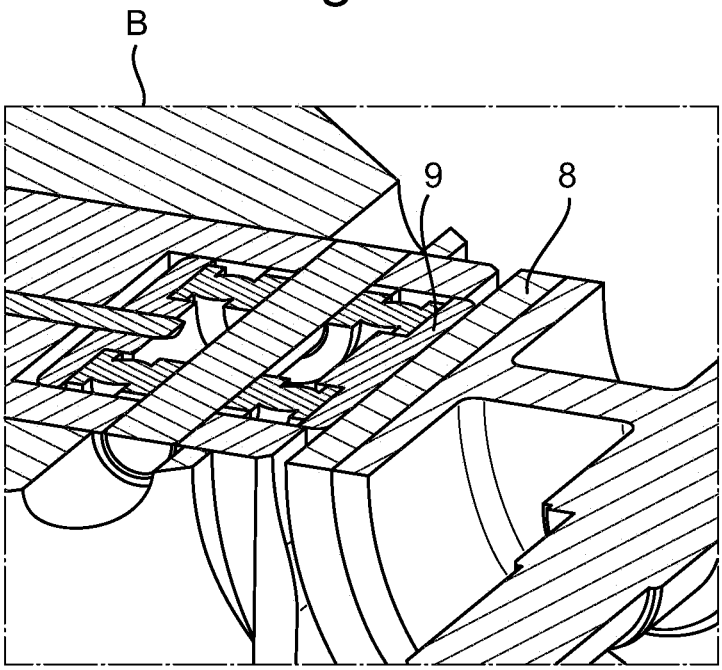

FIG. 6*b* shows an enlarged portion B of FIG. 5*a*.

Figure 7:
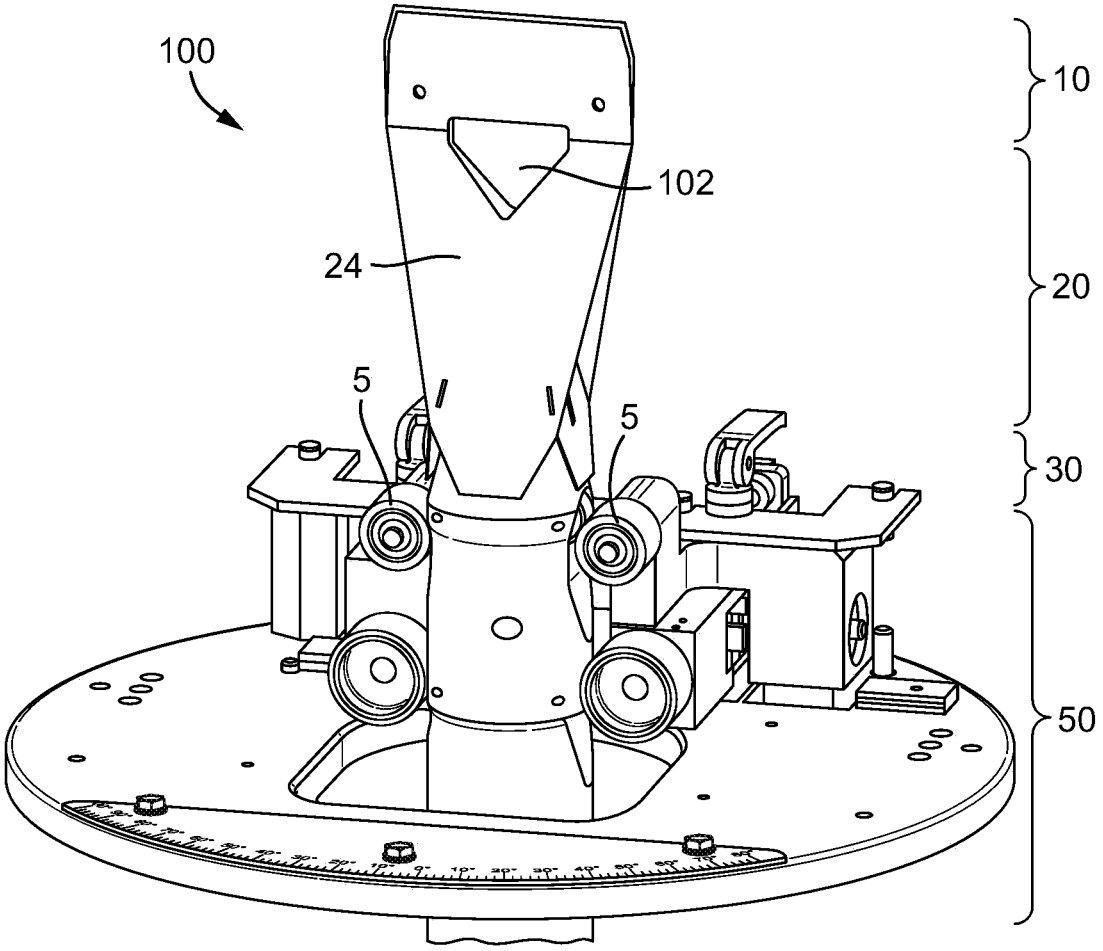

FIG. 7 shows a mandrel according to a second embodiment of the present invention.

Figure 8A:
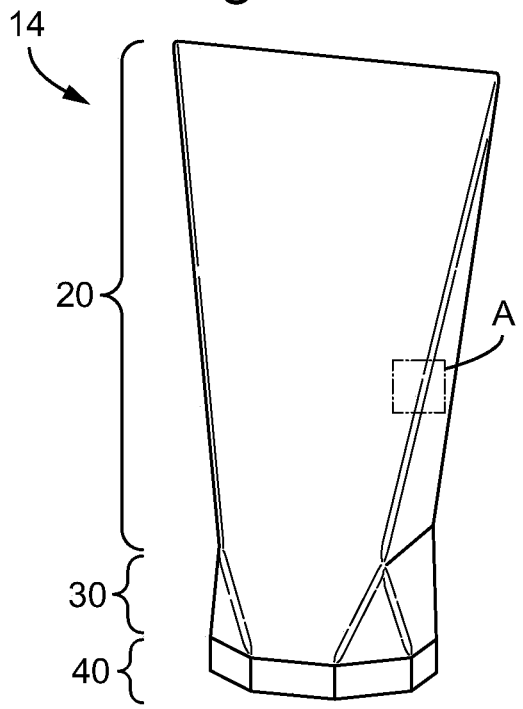

FIG. 8*a* shows a spreading portion having rounded corner points.

Figure 8B:
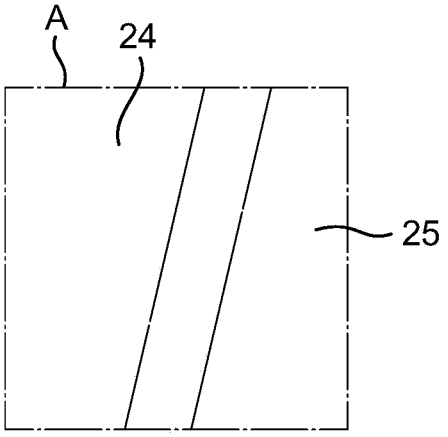

FIG. 8*b* shows an enlarged portion A of FIG. 8*a*

Figure 9A:
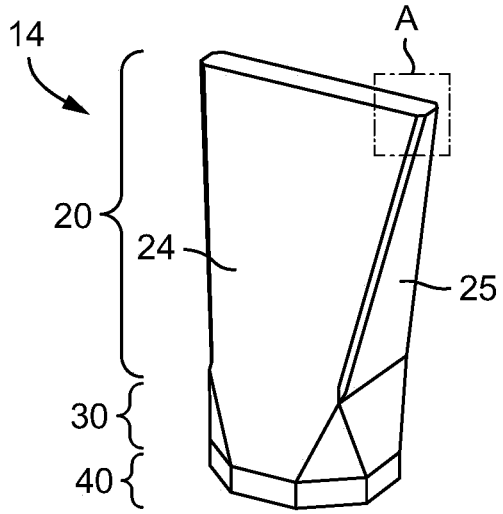

FIG. 9*a* shows a cut spreading portion having chamfered corner points.

Figure 9B:
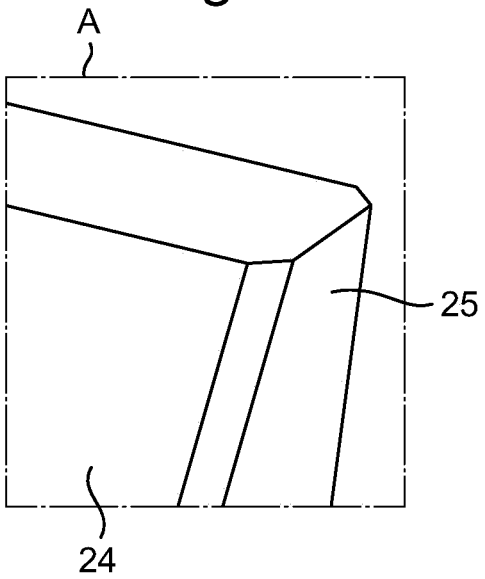

FIG. 9*b* shows an enlarged portion A of FIG. 9*a*.

Figure 10:
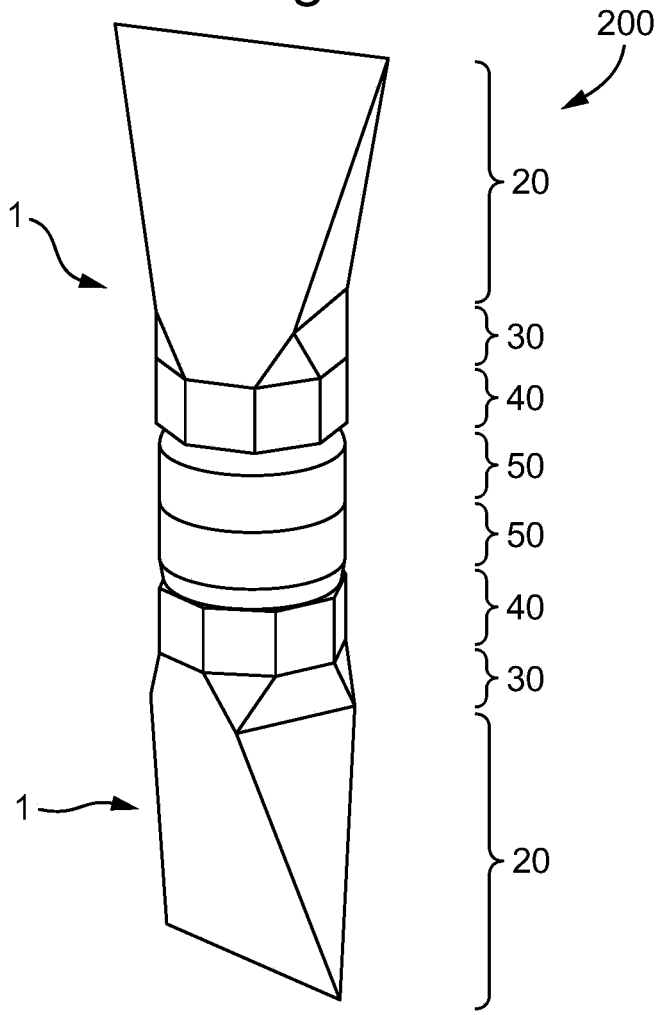

FIG. 10 shows a device for forming folds in a flattened tubular foil.

Figure 11:
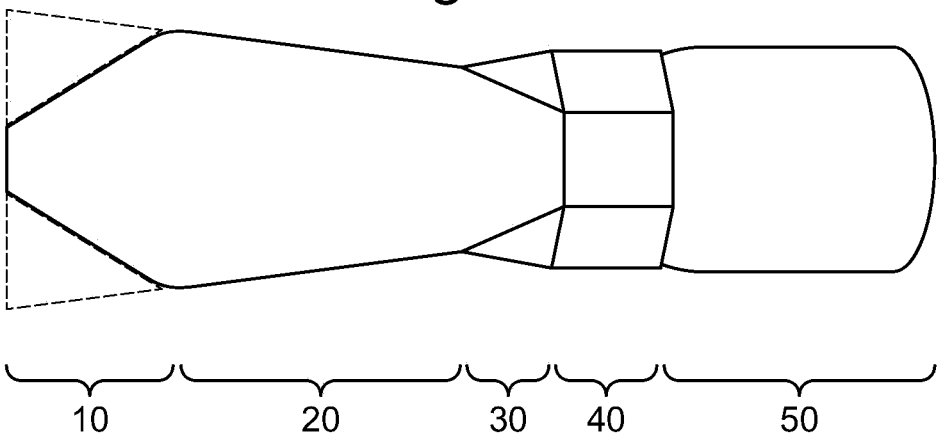

FIG. 11 shows a mandrel having a chamfered tip portion.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it should be understood, however, that this invention is not limited to the precise arrangements shown.

DETAILED DESCRIPTION OF THE EMBODIMENTS

The following description of embodiments of the invention should not be used to limit the scope of the present invention. Other examples, features, aspects, embodiments, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive. Various suitable ways in which the teachings herein may be combined will be readily apparent to those of ordinary skill in the art in view of the teachings herein. Such modifications and variations are intended to be included within the scope of the claims.

First Embodiment

FIGS. 1 to 6*b* show different (schematical) views of a mandrel 1 according to a first embodiment of the invention and a spreading portion 14 of the mandrel 1. It should be noted that, for better understanding, not every figure shows all elements of the mandrel 1 or a sleeving device 3 in which the mandrel 1 is suspended.

Figure 1:
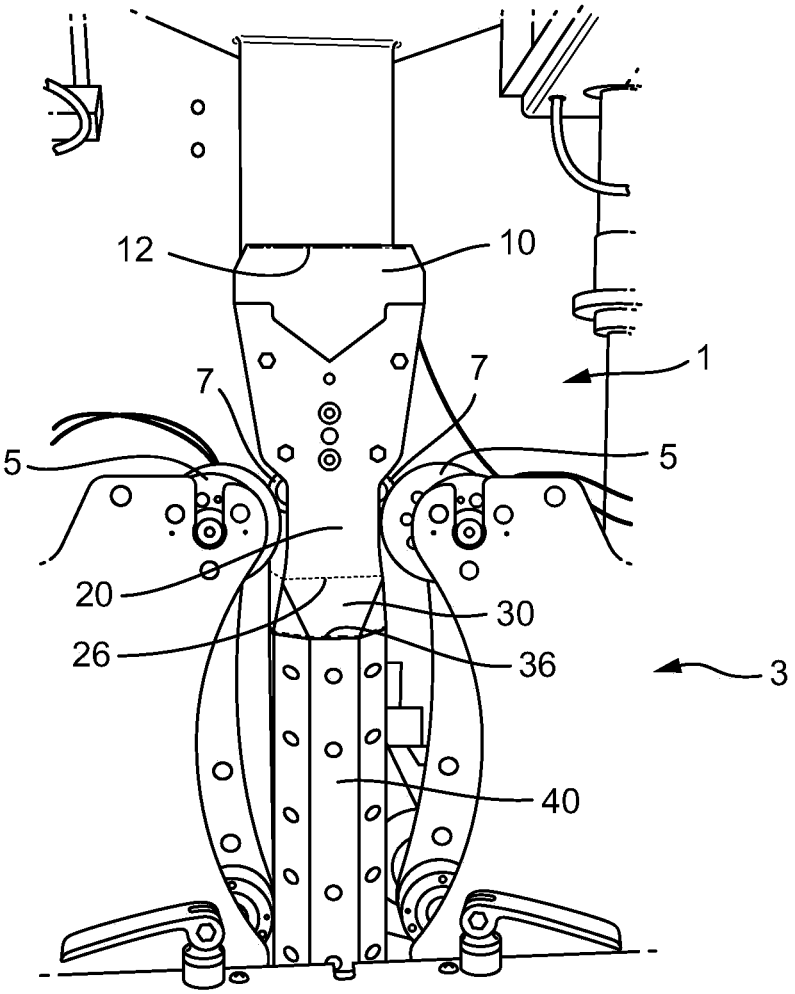
FIG. 1 shows a perspective view of a mandrel according to a first embodiment of the invention.

FIG. 1 shows a mandrel 1 for spreading open a flattened tubular foil into a tubular form having a rounded cross section, wherein the mandrel 1 is suspended in a sleeving device 3. The sleeving device 3 comprises transport rollers 5 which engage with wheels 7 rotatably provided on opposite sides of the mandrel 1. The transport rollers 5 are connected to a drive for driving the transport rollers 5. A foil (not shown) is fed from a reservoir, such as a roll. The foil is provided as a flat continuous film comprising two layers of plastic connected and folded at corners. Thus, the foil having a flattened cross section and two folds (factory folds) extending along a feeding direction of the foil at corners of the foil is fed over the mandrel 1 from top to bottom in FIG. 1 and between the transport rollers 5 and the wheels 7.

The mandrel 1 comprises, in a feeding direction of the tubular foil, a tip portion 10 and a spreading portion 14 having a first length section 20, a second length section 30, and a third length section 40. The tip portion 10 serves for opening the flattened tubular foil and guiding the foil towards the spreading portion 14.

FIGS. 2 to 4*c* schematically show the spreading portion 14 of the mandrel 1 in more detail. The spreading portion 14 comprises the first length section 20 which is configured to change the cross section of the tubular foil from the flattened cross section 12 into a rectangular cross section 22 which is a first polygonal cross section defined by four corner points 22*a* to 22*d*. That is, the first length section 20 spreads open the tubular foil to have a rectangular cross section 22. The first length section 20 is formed by a wedge-like structure and comprises trapezoidal side surfaces 24 tapering in a feeding direction of the tubular foil, wherein the trapezoidal side surfaces 24 are connected by triangular side surfaces 25. The foil contacts the first length section 20 at corner points 22*a* to 22*d* serving as contact points. However, the foil may also be supported via the trapezoidal side surfaces 24 and the triangular side surfaces 25. At the end of the first length section 20 in a feeding direction of the foil, the foil has a square cross section 26.

The spreading portion 14 further comprises the second length section 30 which is configured to change the cross section of the tubular foil from the square cross section 26 into a first octagonal cross section which is a second polygonal cross section defined by eight corner points 32*a* to 32*h*. Similar to the first length section 20, the second length section 30 comprises trapezoidal side surfaces 34 tapering in a feeding direction of the tubular foil, wherein the trapezoidal side surfaces 34 are connected by triangular side surfaces 35. The foil contacts the second length section 30 at corner points 32*a* to 32*h* serving as contact points. The first octagonal cross section is a non-equilateral octagonal cross section 32. At the end of the second length section 30 in a feeding direction of the foil, the foil has a second octagonal cross section which is an equilateral octagonal cross section 36.

The spreading portion 14 further comprises the third length section 40 following the second length section 30 which is configured to guide the tubular foil having the equilateral octagonal cross section 36 along the feeding direction of the foil. In the third length section 40, the equilateral octagonal cross section 36 is not changed and thus remains constant.

Accordingly, the mandrel 1 has a circumferentially closed hollow structure, i.e. the contour of the mandrel 1 is formed from closed side surfaces, which is formed by elements having simple geometrical shapes. Further, the mandrel 1 is configured such that a circumferential length of the cross section of the tubular foil remains constant along the central axis 2. That is, the circumferential length of the flattened cross section 12, the circumferential length of the rectangular cross section 22, the circumferential length of the square cross section 26, the circumferential length of the non-equilateral octagonal cross section 32, and the circumferential length of the equilateral octagonal cross section 36 is the same. By keeping the circumferential length of the cross section of the tubular foil constant over the entire length of the mandrel 1 in a feeding direction, wrinkles and creases in the foil can be avoided. FIG. 4*d* schematically shows circumferences of the tubular foil at an arbitrary first position and an arbitrary second position along a central axis of the tubular foil. A circumferential length of the cross section at the first position is equal to a circumferential length of the cross section at the second position.

As FIG. 4*d*, FIG. 5*d* schematically shows circumferences/cross sections of the tubular foil at an arbitrary first position and an arbitrary second position along the central axis of the tubular foil corresponding to the central axis 2 of the mandrel 1. A first cross section of the tubular foil at the first position along the central axis 2 of the mandrel 1 is divided into a specific number of nodes N1 to Nn being located at equal distances from each other along the circumference of the first cross section. A second cross section of the tubular foil at the second position along the central axis 2 of the mandrel 1 is divided into the specific number of nodes M1 to Mn being located at equal distances from each other along the circumference of the second cross section. The distances N1-M1, N2-M2, to Nn-Mn on the tubular foil between equally numbered nodes at the first position and the second position are equal, wherein nodes N1 and M1 are located in a symmetry plane (not shown in FIG. 5*d*) of the mandrel 1 containing the central axis 2 of the mandrel 1. It should be noted that, for the sake of convenience, only part of the entire circumference of the first cross section at the first position is provided with nodes N1 to Nn and only part of the entire circumference of the second cross section at the second position is provided with nodes M1 to Mn. FIGS. 5*a* to 5*c* show the respective distances N1-M1, N2-M2, to Nn-Mn on the spreading portion 14 of the mandrel 1. By keeping the distances N1-M1, N2-M2, to Nn-Mn equal, wrinkles or creases in the tubular foil can be avoided.

Figure 2:
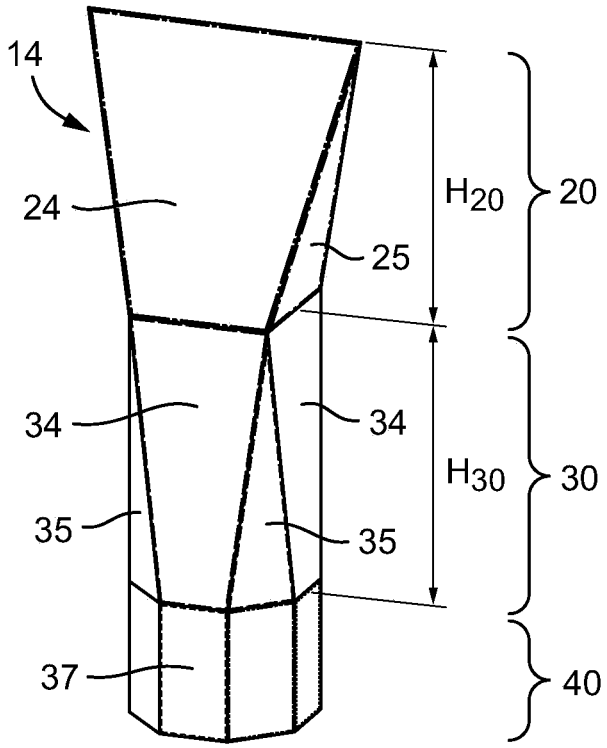
FIG. 2 shows a perspective view of a spreading portion of the mandrel according to the first embodiment of the invention.
Figure 3:
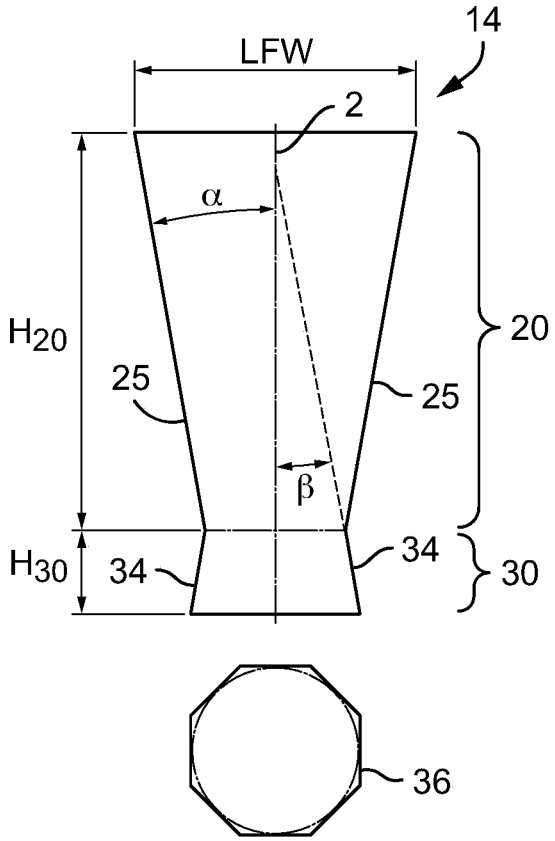
FIG. 3 shows a front cross sectional view along a central axis of the spreading portion of FIG. 2 and a bottom view of the spreading portion of FIG. 2.

FIG. 3 shows a front cross sectional view along a central axis 2 of the spreading portion of FIG. 2 and a bottom view of the spreading portion of FIG. 2. From a mechanical point of view, it is desired that a height of transition from the flattened cross section 12 having a lay flat width LFW to the equilateral octagonal cross section 36, which is the sum of a vertical height $H_{20}$ and a vertical height $H_{30}$ is as small as possible in order to minimize the required operating space. Experiments have shown that a suitable height of transition $H_{20}+H_{30}$ can be determined if an angle $\alpha$ between the central axis 2 and the triangular side surfaces 25 of the first length section 20 is the same as an angle $\beta$ between the central axis 2 and the trapezoidal side surfaces 34 of the second length section 30. In the shown embodiment, the angle $\alpha=\beta$ is 12°.

FIG. 6 discloses the mandrel 1 according to the first embodiment, wherein the mandrel 1 is shown upside down. That is, in FIG. 6, the feeding direction of the foil is from bottom to top. The mandrel 1 of FIG. 5 comprises a rounding portion 50 (which is not shown in FIG. 1) configured to change the cross section of the tubular foil from the equilateral octagonal cross section 36 into a rounded cross section. Further, FIGS. 6 to 6*b* each show two driving wheels 9 rotatably mounted inside the third length section 40 so that a circumferential surface of each driving wheel 9 is flush with an outer surface 37 of the third length section 40. As the circumferential surface of each driving wheel 9 is flush with an outer surface 37 of the third length section 40, the foil which is guided between each driving wheel 9 and a servo driven wheel 8 provided outside of the mandrel 1 can be fed over the mandrel 1 without causing any wrinkles or creases in the foil. Specifically, as indicated in the enlarged view B of FIG. 6*b*, if no foil is provided between the driving wheel 9 and the servo driven wheel 8, the contact between the driving wheel 9 and the servo driven wheel 8 results in a straight line.

Second Embodiment

FIG. 7 shows a mandrel 100 according to a second embodiment of the present invention. In contrast to the mandrel 1 of the first embodiment, the mandrel 100 does not comprise the third length section 40. That is, at the end of the second length section 30 in a feeding direction of the foil along the central axis of the mandrel 100, the foil has an equilateral octagonal cross section 36 which is then changed into a rounded cross section by the rounding portion 50. Further, transport rollers 5 for suspending the mandrel 100 are provided outside of the mandrel 100 in a region of the rounding portion 50. In contrast, in the first embodiment as shown in FIG. 1, the transport rollers 5 are provided in a region of the first length section 20.

Moreover, the first length section 20 of the spreading portion 14 of the mandrel 100 according to the second embodiment has a contour which is formed from partially open side surfaces. That is, the first length section 20 comprises trapezoidal side surfaces 24 tapering in a feeding direction of the tubular foil. However, the trapezoidal side surfaces 24 are not connected by triangular side surfaces. This allows the weight of the mandrel 100 to be reduced. To this purpose, as shown in FIG. 6, the mandrel 100 further comprises an opening 102.

Further Applications and Modifications

In the first embodiment as shown in the schematical drawings of FIGS. 2 and 4*a* to 5*a*, the corner points between the trapezoidal surfaces and triangular surfaces are sharp. However, as shown in FIGS. 8*a* to 8*b*, the corner points between the trapezoidal side surfaces 24 and the triangular side surfaces 25 may alternatively be rounded instead of being sharp. Of course, also the corner points in the second length section 30 and in the third length section 40 may be rounded instead of being sharp.

Alternatively, as shown in FIGS. 9*a* and 9*b*, the corner points in the first length section 20, the second length section 30 and in the third length section 40 may be chamfered instead of being sharp or rounded.

FIG. 10 shows a device 200 for forming folds in a flattened tubular foil, comprising a first mandrel 1 according to the first embodiment and a second mandrel 1 according to the first embodiment, wherein the first mandrel 1 and second mandrel 1 are arranged one after another such that the central axis of the first mandrel 1 and the second mandrel 1 coincide with each other. However, the second mandrel 1 is turned with respect to the first mandrel 1 around 180 degrees. That is, the device 200 is configured such that the rounding portion 50 of the first mandrel 1 and the rounding portion 50 of the second mandrel 1 are connected. Further, the second mandrel 1 is turned with respect to the first mandrel 1 around the central axis such that an orientation of the foil fed over the first mandrel 1 and an orientation of the foil leaving the second mandrel 1 differ from each other, i.e. such that the first length sections 20 and the second length sections 30 of the first mandrel 1 and second mandrel 1 are not congruent. By changing an orientation of the foil by the device 200, two additional folds can be created in the foil at the edges of the flattened tubular foil leaving the second mandrel 1. Thus, as the flattened tubular foil being fed over the first mandrel 1 already comprises two folds (factory folds) extending along the foil in a feeding direction at edges of the flattened tubular foil, the device 200 can create foils having a total of four folds. A distance of the additional folds created by the device 200 from each other in a circumferential direction of the foil depends on a turning angle of the first mandrel 1 with respect to the second mandrel 1 around the central axis. By using two of the mandrels 1 according to the first embodiment, the created foil having four folds can be produced while avoiding wrinkles or creases. It is noted that FIG. 10 does not disclose the tip portions 10 of the first and second mandrels 1.

FIG. 11 shows a modified mandrel for opening already cut sleeves in which the tip portion 10 is chamfered in order to prevent jams.

In the first embodiment shown in FIG. 3, the angle $\alpha=\beta$ is 12°. However, the angle $\alpha=\beta$ may lie in a range from 5° to 25°, preferably in a range from 12° to 15°. However, alternatively, the angles $\alpha$ and $\beta$ may differ from each other.

In the first embodiment, the first length section 20, the second length section 30 and the third length section 40 each is a three dimensional structure the contour of which is formed from closed side surfaces (trapezoidal, triangular and rectangular side surfaces). However, alternatively, the three dimensional structure may have a contour which is formed from partially opened side surfaces as in the second embodiment.

The first length section 20 of the mandrel 100 according to the second embodiment has a contour which is formed from partially open side surfaces. Alternatively, the first length section 20 of the second embodiment may be formed from closed side surfaces as in the first embodiment.

LIST OF REFERENCE SIGNS

1 mandrel
2 central axis
3 sleeving device
5 transport roller
7 wheel
8 servo driven wheel
9 driving wheel
10 tip portion
12 flattened cross section
14 spreading portion
20 first length section
22 rectangular cross section
22*a* to 22*d* corner point
24 trapezoidal side surface
25 triangular side surface

26 square cross section
30 second length section
32 non-equilateral octagonal cross section
32*a* to 32*h* corner point
34 trapezoidal side surface
35 triangular side surface
36 equilateral octagonal cross section
37 outer surface
40 third length section
50 rounding portion
100 mandrel
102 opening
200 device
$H_{20}$ vertical height of first length section
$H_{30}$ vertical height of second length section
LFW lay flat width

The invention claimed is:

1. A mandrel to be suspended in a sleeving device, for spreading open a flattened tubular foil into a tubular form having a rounded cross section, the mandrel comprising:

a spreading portion which extends in a feeding direction of the foil along a central axis of the mandrel and is configured to change a cross section of the tubular foil from a flattened cross section into a rounded cross section, the spreading portion comprises, in a feeding direction of the tubular foil:

a first length section configured to change the cross section of the tubular foil from the flattened cross section into a first polygonal cross section defined by four corner points, and a second length section configured to change the cross section of the tubular foil from the first polygonal cross section into a second polygonal cross section defined by eight or more corner points, wherein a cross section of the spreading portion at any position along the central axis is defined by n contact points configured to contact the tubular foil, with n=4 along the first length section and n≥8 along the second length section, so that a polygonal chain of substantially straight line segments connecting the n contact points defines a polygonal cross section of the tubular foil.

2. The mandrel according to claim 1, wherein the first length section is configured to change the cross section of the tubular foil from the flattened cross section into a rectangular cross section and, then, into a square cross section.

3. The mandrel according to claim 1, wherein the second length section is configured to change the cross section of the tubular foil from the first polygonal cross section into an octagonal cross section.

4. The mandrel according to claim 1, wherein the second length section is further configured to change the cross section of the tubular foil from a first octagonal cross section into a second octagonal cross section, wherein the first octagonal cross section is a non-equilateral octagonal cross section and the second octagonal cross section is an equilateral octagonal cross section.

5. The mandrel according to claim 1, the spreading portion further comprises a third length section following the second length section and configured to guide the tubular foil with the second polygonal cross section along the feeding direction.

6. The mandrel according to claim 5, further comprising an advancing means with at least one driving wheel rotatably mounted inside the third length section so that a circumferential surface of the driving wheel is flush with an outer surface of the third length section.

7. The mandrel according to claim 1, further comprising a rounding portion configured to change the cross section of the tubular foil from the second polygonal cross section into a rounded cross section.

8. The mandrel according to claim 1, wherein the mandrel is configured to change the cross section of the tubular foil from the flattened cross section into the rounded cross section so that the tubular foil has a same circumferential length at any position along the central axis of the mandrel.

9. The mandrel according to claim 1, wherein the mandrel is configured to change the cross section of the tubular foil from the flattened cross section into the rounded cross section so that, if a first cross section of the tubular foil at any first position along the central axis of the mandrel is divided into a specific number of nodes N1 to Nn being located at equal distances from each other along the circumference of the first cross section, and a second cross section of the tubular foil at any second position along the central axis of the mandrel is divided into the specific number of nodes M1 to Mn being located at equal distances from each other along the circumference of the second cross section, distances N1-M1, N2-M2, to Nn-Mn on the tubular foil between equally numbered nodes at the first position and the second position are equal, wherein nodes N1 and M1 are located in a symmetry plane of the mandrel containing the central axis of the mandrel.

10. The mandrel according to claim 1, wherein the spreading portion causes any polygonal cross section of the tubular foil to have rounded or chamfered corner points.

11. The mandrel according to claim 1, wherein the spreading portion is formed by a wedge-like structure wherein each of the first length section and second length section is defined by trapezoidal side surfaces tapering in a feeding direction of the tubular foil, wherein the n contact points lie on side edges of the trapezoidal side surfaces.

12. The mandrel according to claim 11, wherein the trapezoidal side surfaces are connected by triangular side surfaces.

13. The mandrel according to claim 1, wherein the spreading portion further comprises a tip portion upstream of the first length section, configured to receive and guide the flattened tubular foil to the first length section.

14. A device for forming folds in a flattened tubular foil, comprising a first mandrel according to claim 1 and a second mandrel according to claim 1, wherein the first mandrel and second mandrel are arranged such that the central axis of the first mandrel and second mandrel coincide with each other and tip portions of the first mandrel and second mandrel are positioned opposite to each other, and wherein the second mandrel is turnable with respect to the first mandrel around its central axis so that the first length sections and second length sections of the first mandrel and second mandrel are not congruent.

15. A sleeving device for arranging a sleeve around a container, the sleeving device comprising:

a frame, a foil feeding unit mounted to the frame configured to feed a tubular foil to the mandrel according to claim 1 suspended to the frame, a cutting unit for cutting the tubular foil to form a sleeve, and a sleeve dispatch configured to dispatch the sleeve from the mandrel onto the container.

16. A mandrel to be suspended in a sleeving device, for spreading open a flattened tubular foil into a tubular form having a rounded cross section, the mandrel comprising:

a spreading portion which extends in a feeding direction of the foil along a central axis of the mandrel and is configured to change a cross section of the tubular foil from a flattened cross section into a rounded cross section, the spreading portion comprises, in a feeding direction of the tubular foil:

a first length section configured to change the cross section of the tubular foil from the flattened cross section into a first polygonal cross section defined by four corner points, and a second length section configured to change the cross section of the tubular foil from the first polygonal cross section into a second polygonal cross section defined by eight or more corner points, wherein the second length section is further configured to change the cross section of the tubular foil from a first octagonal cross section into a second octagonal cross section, wherein the first octagonal cross section is a non-equilateral octagonal cross section and the second octagonal cross section is a substantially equilateral octagonal cross section.

17. A device for forming folds in a flattened tubular foil, comprising a first mandrel and a second mandrel, wherein each of the first and second mandrel comprise, respectively:

a spreading portion which extends in a feeding direction of the foil along a central axis of the mandrel and is configured to change a cross section of the tubular foil from a flattened cross section into a rounded cross section, the spreading portion comprises, in a feeding direction of the tubular foil:

a first length section configured to change the cross section of the tubular foil from the flattened cross section into a first polygonal cross section defined by four corner points, and a second length section configured to change the cross section of the tubular foil from the first polygonal cross section into a second polygonal cross section defined by eight or more corner points, wherein the first mandrel and second mandrel are arranged such that the central axis of the first mandrel and second mandrel coincide with each other and tip portions of the first mandrel and second mandrel are positioned opposite to each other, and wherein the second mandrel is turnable with respect to the first mandrel around its central axis so that the first length sections and second length sections of the first mandrel and second mandrel are not congruent.

* * * * *